US007036225B2

(12) United States Patent
Goto

(10) Patent No.: US 7,036,225 B2
(45) Date of Patent: May 2, 2006

(54) PROCESS FOR TREATING COIL END UPON WINDING OF COIL

(75) Inventor: Yoshihide Goto, Yamagata (JP)

(73) Assignee: Goto Electronic Co., Ltd., Yamagata (JP)

( * ) Notice: Subject to any disclaimer, the term of this patent is extended or adjusted under 35 U.S.C. 154(b) by 418 days.

(21) Appl. No.: 10/214,012

(22) Filed: Aug. 7, 2002

(65) Prior Publication Data

US 2003/0136000 A1 Jul. 24, 2003

(30) Foreign Application Priority Data

Jan. 24, 2002 (JP) ..... 2002-015190

(51) Int. Cl.
*H01R 43/02* (2006.01)

(52) U.S. Cl. ..... 29/860; 29/33 B; 29/564.4; 29/605; 29/748; 29/850; 29/867; 219/55.21

(58) Field of Classification Search ..... 29/564.4, 29/602.4, 605, 606, 857, 860, 867, 868, 874, 29/33 B, 602.1, 748, 848, 850; 81/9.4; 219/55.21, 219/55.22; 336/192
See application file for complete search history.

(56) References Cited

U.S. PATENT DOCUMENTS 3,765,276 A * 10/1973 Pollitt ..... 81/9.51
3,780,928 A * 12/1973 Shirn ..... 29/564.4
4,072,176 A * 2/1978 Friend ..... 29/753
4,687,898 A * 8/1987 Riordan et al. ..... 219/56.22
4,860,433 A * 8/1989 Miura ..... 29/605
5,210,928 A * 5/1993 Seshita et al. ..... 29/596
5,977,852 A * 11/1999 Schoettl ..... 335/278
6,442,833 B1 * 9/2002 Mizuno et al. ..... 29/867

* cited by examiner

*Primary Examiner*—Minh Trinh
*Assistant Examiner*—Donghai D. Nguyen
(74) *Attorney, Agent, or Firm*—Reising, Ethington, Barnes, Kisselle, P.C.

(57) ABSTRACT

A process for treating a coil end is provided, by which upon automatic winding of the coil, an electric connection between a portion of a wire at the front or rear end of the coil and a terminal of a winding object by arc welding can be securely carried out. A stripping section strips an insulating coating off from the portions of the wire at the front and rear ends of the coil while the wire is wound around the winding object with the portions of the wire being bound to the terminal. Each portion of the wire, the insulating coating of which is stripped off, bound to the terminal is electrically connected to the terminal by arc welding.

1 Claim, 3 Drawing Sheets

PROCESS FOR TREATING COIL END UPON WINDING OF COIL

BACKGROUND OF THE INVENTION (1) Field of the Invention

The present invention relates to a process for treating a coil end upon automatic winding of the coil used for a motor, relay or transformer, by which each of a portion of the wire (i.e. electric wire) at the front end of the coil and a portion of the wire at the rear end of the coil is bound to a corresponding terminal formed on a winding object.

(2) Description of the Related Art

So far, for example, in case of a multi-spindle automatic winding device of coil, each of the portion of the wire at the front end of the coil and the portion of the wire at the rear end of the coil as insulation-treated has been bound to a corresponding metal terminal formed on a winding object such as a coil bobbin by winding each of the wire around the corresponding terminal with about three to six turns.

An example of the winding object is shown in FIG. 6. The winding object 1 is provided with a terminal 2, to which a portion of a wire at the front end of a first coil is bound, and a terminal 3, to which a portion of the wire at the rear end of the first coil is bound, with each terminal protruding upward. The winding object 1 is further provided with a terminal 4, to which a portion of a wire at the front end of a second coil is bound, and a terminal 5, to which a portion of the wire at the rear end of the second coil is bound, with each terminal protruding upward.

In general, a portion of the wire at the front or rear end of the coil, which is bound to the corresponding terminal of the winding object, has been electrically connected to the terminal by arc welding in a downstream process. In the arc welding process, a high voltage electricity is applied between an electrode and a terminal to be welded so as to generate an arc and high heat simultaneously, by which the portion of the wire at the front or rear end of the coil and the terminal are melted and joined together, thereby the electric connection is attained.

In a conventional process for treating a coil end upon winding of the coil as described above, the portion of the wire at the front or rear end of the coil is electrically connected to the terminal by arc welding. In an arc welding, since the arc tends to blow to a position at which the electricity is easily conducted, therefore it is an important subject how to blow a stable arc to a portion to be welded.

However, in the conventional process for treating a coil end as described above, an insulating coating of a wire (i.e. electric wire) affects an arc restraining the arc from blowing, resulting in an incomplete welding. As a result, there has been a possibility that the coils thus manufactured might include a defective coil, which cannot be used for electrical conduction, thereby deteriorating the reliability of the product.

SUMMARY OF THE INVENTION

It is therefore an objective of the present invention to solve the above problem and to provide a process for treating a coil end, by which upon automatic winding of the coil, the electric connection between the portion of the wire at the front or rear end of the coil and the terminal by arc welding can be securely carried out.

In order to attain the above objective, the present invention is to provide a process for treating a coil end upon automatic winding of the coil, in which a wire with an insulating coating is wound around a winding object including a terminal to be electrically connected to a portion of the wire at the front end of the coil and a terminal to be electrically connected to a portion of the wire at the rear end of the coil, so that the coil is formed, the process comprising the step of:

stripping the insulating coating off from the portions of the wire at the front and rear ends of the coil while the wire is wound around the winding object and the portions of the wire are bound to the terminal.

With the process described above, since the insulating coating is stripped off from the portions of the wire at the front and rear ends of the coil while the wire is wound around the winding object with the portions of the wire being bound to the terminal, the exposed area of the conductor of each portion of the wire can be increased. Accordingly, upon the arc welding, the arc can be stably blown, that is, the arc welding can securely be carried out, resulting in that the problem of the electric connection described above can be completely solved and a coil having high reliability and high quality can be provided.

Preferably, in the step of stripping, the insulating coating is streakily stripped off from the portions of the wire in an axial direction of the wire.

With the process described above, since the insulating coating can be streakily stripped off from the portions of the wire at the front and rear ends of the coil in an axial direction of the wire, therefore the stripping process can continuously be carried out securely and easily without influencing the path of the wire for making the coil, thereby the productivity of the coil can be raised.

Preferably, the portions of the wire to be bound to the corresponding terminals are subjected to an arc welding so as to be electrically connected to the terminal.

With the process described above, since the insulating coating is stripped off from the portions of the wire at the front and rear ends of the coil, the merit of the arc welding can be sufficiently utilized. Further, the workability can be improved, the electric connection between the portion of the wire at the front or rear end of the coil and the terminal can be securely carried out, and a coil having high reliability and high quality can be provided.

DESCRIPTION OF THE PREFERRED EMBODIMENTS

In the following, the preferred embodiments of the present invention will be explained with reference to the attached drawings.

Figure 1:
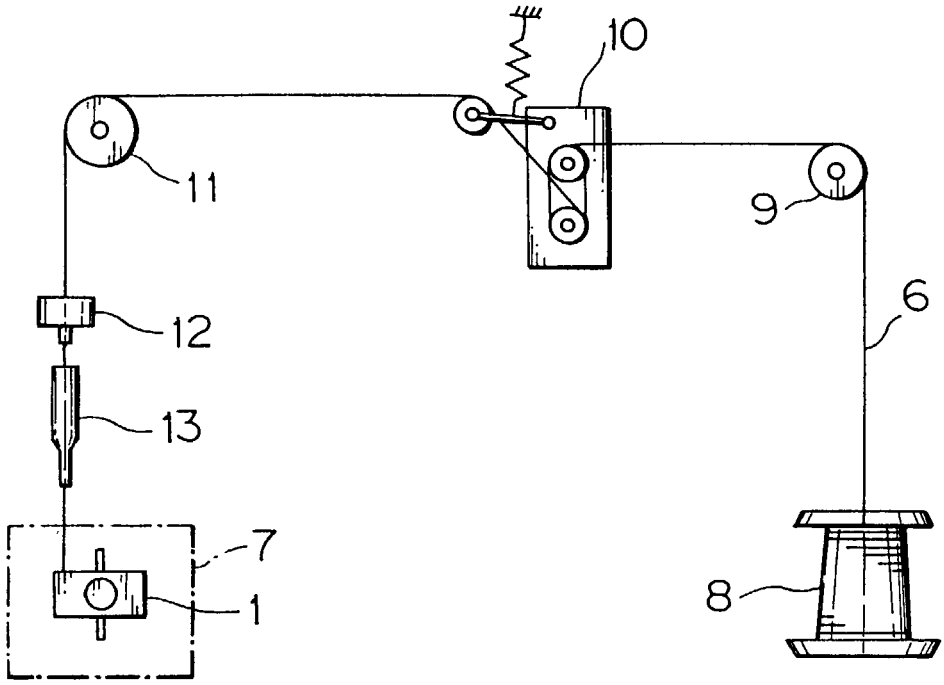
FIG. 1 is a schematic constitution illustrating a preferred embodiment of a process for treating a coil end upon winding of the coil according to the present invention.

FIG. 1 is a schematic constitution illustrating a preferred embodiment of a process for treating a coil end upon winding of the coil according to the present invention. A process, in which a wire 6 is conveyed to an automatic coil winding section 7 will be explained with reference to FIG. 1 as follows. First, the wire 6 wound around a wire bobbin 8 is conveyed to a tension mechanism 10 by way of a guide roller 9.

Figure 6:
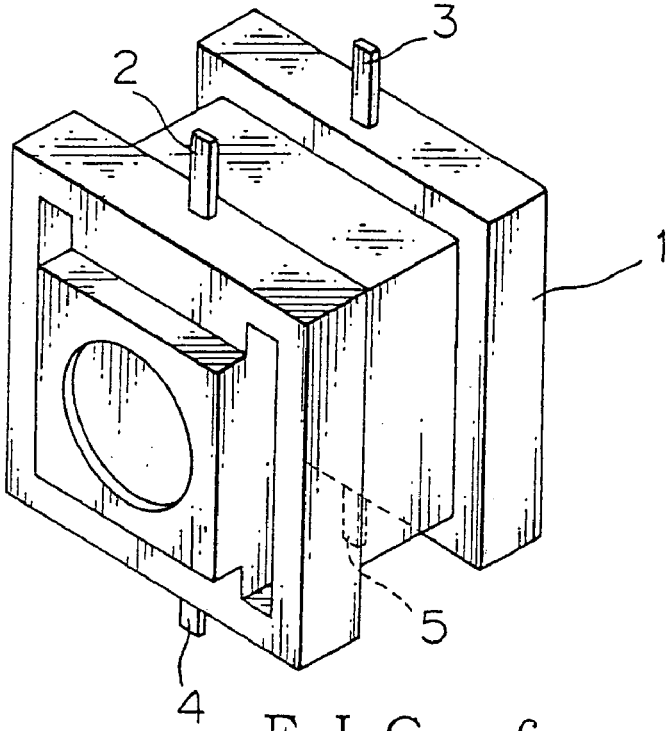
FIG. 6 is a perspective view illustrating an example of a winding object.

The wire 6 is provided with a specific tension by the tension mechanism 10 and thereafter is conveyed to a stripping section 12, in which the portions of the wire at the front and rear ends of the coil are subjected to a stripping treatment and thereafter, is conveyed to the automatic coil winding section 7 equipped with a winding subject such as the winding subject 1 shown in FIG. 6 by way of a wire-guiding section 13.

Figure 2:
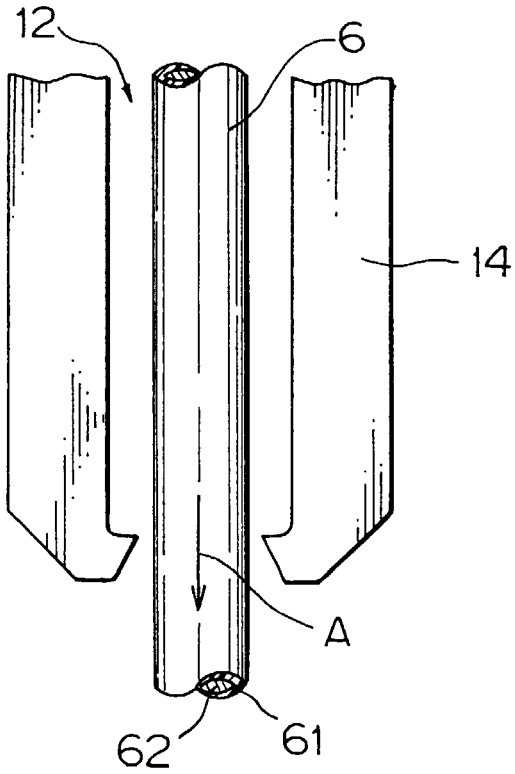
FIG. 2 is a front view illustrating a primary constitution of a stripping section for a wire shown in FIG. 1.
Figure 3:
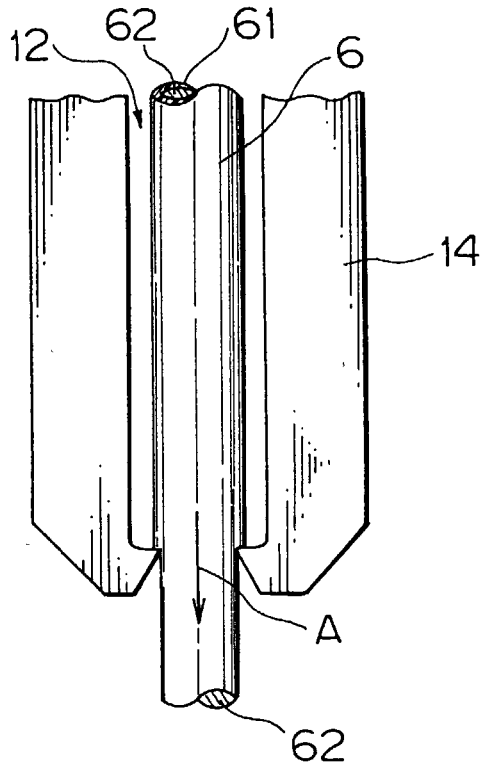
FIG. 3 is a front view illustrating a primary constitution of a stripping section for a wire shown in FIG. 1.

The stripping section 12 for stripping an insulating coating off from the wire is constructed as shown in FIGS. 2 and 3, each of which is a front view illustrating a primary constitution of a stripping section 12 for the wire shown in FIG. 1. The stripping section 12 includes a cutter mechanism 14 having at least two blades disposed so as to nip the wire 6 from the surroundings, which is being conveyed continuously in the direction indicated by arrow A shown in FIGS. 2 and 3. During a normal winding, that is, when the wire 6 is being wound around, for example, the winding object 1 shown in FIG. 6 in the automatic coil winding section 7, in the stripping section 12 the cutter mechanism 14 is situated at a position where the cutter mechanism 14 is parted away from the wire 6 as shown in FIG. 2, therefore the insulating coating 61 is not stripped off.

To the contrary, when the portion of the front or rear end of the coil of the wire 6 passes through the stripping section 12, the passing is automatically detected, and the cutter mechanism 14 starts to act as shown in FIG. 3, that is, the cutter mechanism 14 nips the wire 6, strips the insulating coating 61 off from the wire 6, and exposes a conductor 62 to air. At that time, preferably the cutter mechanism 14 streakily strips the insulating coating 61 off from each corresponding portion of the wire 6 in an axial direction of the wire 6 as the wire 6 is conveyed. An example of thus streakily stripped state of the wire 6 is shown as a part B with diagonal lines in FIG. 4.

Figure 4:
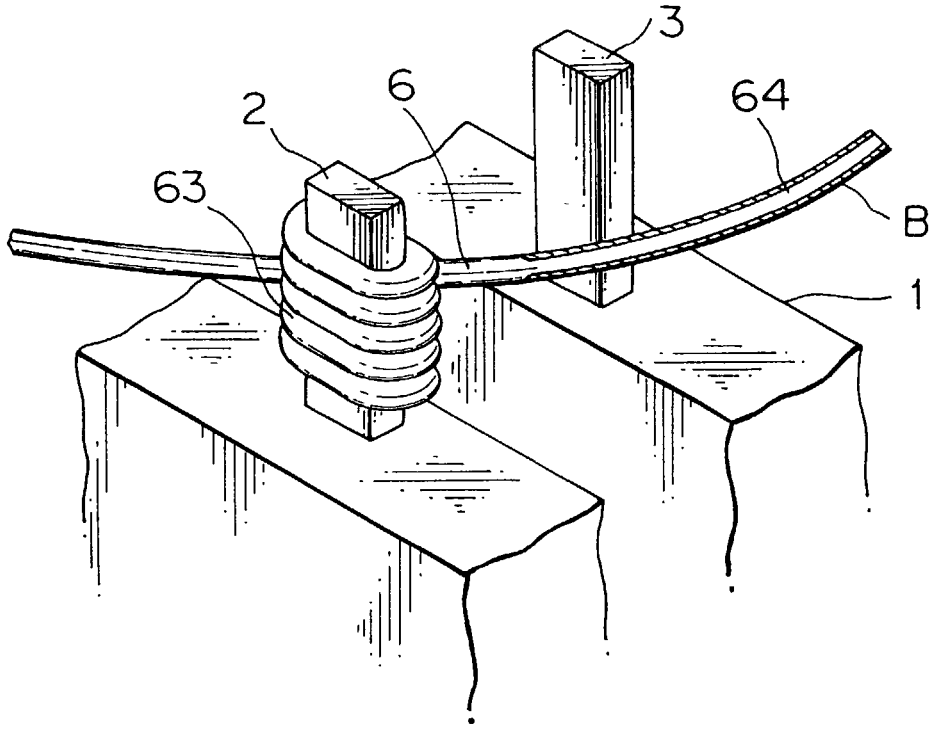
FIG. 4 is a perspective view illustrating a primary constitution of a winding object.

FIG. 4 illustrates a state that the portion 63 of the wire at the front end of the coil, in which the insulating coating 61 is streakily stripped off from the wire 6, has been bound to a terminal 2 of the winding object 1. FIG. 4 further illustrates a state that the portion 64 of the wire at the rear end of the coil, in which the insulating coating 61 is streakily stripped off from the wire 6, is about to be bound to a terminal 3 of the winding object 1.

Figure 5:
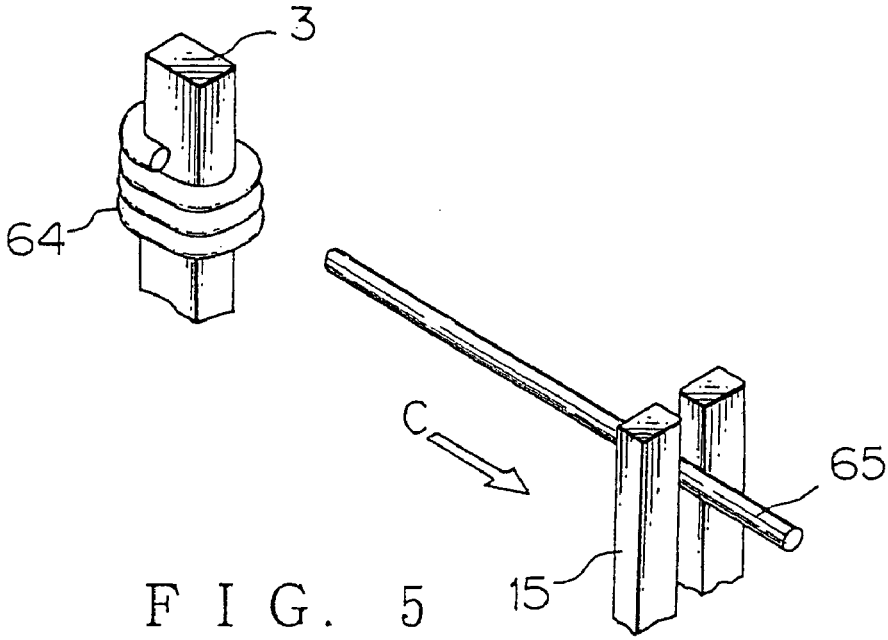
FIG. 5 is a perspective view illustrating a cutting of a wire.

As shown in FIG. 5, in a cutting process, in which the very end 65 of the portion 64 of the wire at the rear end of the coil bound to the terminal 3 is cut, first the very end 65 is moved to a clamp mechanism 15 and clamped by the clamp mechanism 15 and thereafter the clamp mechanism 15 is slid in the direction indicated by arrow C to strongly pull the very end 65, thereby the very end 65 is cut.

Each portion of the wire at the front or rear end of the coil, which has been subjected to the stripping process and the binding process to the corresponding terminal continuously as described above, is further subjected to arc welding so as to carry out the electric connection. In the arc welding process, due to the high heat generated as the arc is generated, the portion of the wire at the front or rear end of the coil and the terminal are melted and joined together, thereby the electric connection is attained. Upon the arc welding, since each portion of the wire at the front or rear end of the coil, which has been subjected to the stripping, is bound to the corresponding terminal, therefore an exposed area of the conductor is increased, resulting in that the arc can be stably blown and thus the electric connection can securely be carried out.

Further, since each portion of the wire at the front or rear end of the coil is subjected to the stripping of the insulating coating, therefore an electric connection by soldering can be carried out besides the electric connection by the arc welding as described above. Furthermore, since the solder can easily adhere to the stripped part, therefore a period of time required for soldering can be shortened.

The aforementioned preferred embodiments are described to aid in understanding the present invention and variations may be made by one skilled in the art without departing from the spirit and scope of the present invention.

What is claimed is:

1. A process for treating a coil end upon automatic winding of the coil, in which a wire with an insulating coating is wound around a winding object including a first terminal to be electrically connected to a first portion of the wire at the front end of the coil and a second terminal to be electrically connected to a second portion of the wire at the rear end of the coil, so that the coil is formed, the process comprising the steps of:

stripping off the insulating coating from axially extending and circumferentially spaced apart first parts only of the first and second portions of the wire at the front and rear ends of the coil in an axial direction of the wire such that axially extending second parts of the first and second portions of the wire between the axially extending first parts remain covered with the insulating coating, whereby, around both of the first and second portions of the wire, there are alternately the first parts stripped of the insulating coating and the second parts covered with the insulating coating, and binding the first and second portions of the wire to the first and second terminals respectively, wherein the stripping step and the binding step are continuously executed, wherein the stripping is performed by using a cutter mechanism having at least two blades disposed so as to nip the wire, and wherein the first portion of the wire to be bound to the first terminal and the second portion of the wire to be bound to the second terminal are subjected to an arc welding so as to be electrically connected to the terminals.

* * * * *